US010934116B2

(12) United States Patent
Yoshida

(10) Patent No.: US 10,934,116 B2
(45) Date of Patent: Mar. 2, 2021

(54) IMAGE FORMING APPARATUS

(71) Applicant: CANON KABUSHIKI KAISHA, Tokyo (JP)

(72) Inventor: Atsushi Yoshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 16/218,803

(22) Filed: Dec. 13, 2018

(65) Prior Publication Data

US 2019/0193969 A1 Jun. 27, 2019

(30) Foreign Application Priority Data

Dec. 26, 2017 (JP) ..... JP2017-250195

(51) Int. Cl.
*B65H 5/38* (2006.01)
*G03G 15/00* (2006.01)
(Continued)

(52) U.S. Cl.
CPC ..... *B65H 5/38* (2013.01); *B65H 5/06* (2013.01); *B65H 5/062* (2013.01); *B65H 5/36* (2013.01); *B65H 29/125* (2013.01); *B65H 29/52* (2013.01); *B65H 29/70* (2013.01); *B65H 85/00* (2013.01); *G03G 15/234* (2013.01); *G03G 15/6576* (2013.01); *B65H 2301/231* (2013.01); *B65H 2301/33312* (2013.01); *B65H 2301/51256* (2013.01); *B65H 2404/55* (2013.01); *B65H 2404/611* (2013.01); *B65H 2515/34* (2013.01); *B65H 2801/06* (2013.01); *B65H 2801/27* (2013.01)

(58) Field of Classification Search
CPC ..... B65H 5/068; B65H 29/70; B65H 2301/51256; B65H 2401/1141; B65H 2401/231; B65H 2401/2311; B65H 5/36; B65H 5/38; B65H 29/52
See application file for complete search history.

(56) References Cited

U.S. PATENT DOCUMENTS 4,878,656 A 11/1989 Honjo et al.
5,453,823 A * 9/1995 Hashizume ..... G03G 15/163 399/316

(Continued)

FOREIGN PATENT DOCUMENTS

JP 2017-141092 A 8/2017

*Primary Examiner* — Jeremy R Severson
(74) *Attorney, Agent, or Firm* — Venable LLP

(57) ABSTRACT

An image forming apparatus includes an image forming portion configured to form an image on a sheet; a pair of conveyance rotary members arranged downstream of the image forming portion in a sheet conveyance direction and configured to convey the sheet, on which the image is formed, by a conveyance nip; and a guide portion configured to guide the sheet to the conveyance. The guide portion includes a first guide member formed into a sheet shape and having a first stiffness and an abutment surface configured to abut the sheet and a second guide member formed into a sheet shape and having a second stiffness higher than the first stiffness and arranged on a side opposite to the abutment surface of the first guide member, wherein a downstream edge of the first guide member is closer to the conveyance nip than a downstream edge of the second guide member.

20 Claims, 10 Drawing Sheets

(51) Int. Cl.

| | |
|---|---|
| ***B65H 5/06*** | (2006.01) |
| ***B65H 29/70*** | (2006.01) |
| ***B65H 29/52*** | (2006.01) |
| ***B65H 85/00*** | (2006.01) |
| ***G03G 15/23*** | (2006.01) |
| ***B65H 29/12*** | (2006.01) |
| ***B65H 5/36*** | (2006.01) |

(56) References Cited

U.S. PATENT DOCUMENTS

| | | | | |
|---|---|---|---|---|
| 8,135,320 | B2 * | 3/2012 | Matsumoto | G03G 15/161 271/264 |
| 9,395,674 | B2 * | 7/2016 | Murooka | G03G 15/6576 |
| 10,152,012 | B2 | 12/2018 | Yoshida et al. | |
| 2004/0218953 | A1 * | 11/2004 | Gross | G03G 15/657 399/400 |
| 2005/0201782 | A1 * | 9/2005 | Fuchiwaki | G03G 15/6558 399/316 |

* cited by examiner

IMAGE FORMING APPARATUS

BACKGROUND OF THE INVENTION

Field of the Invention

The present invention relates to an image forming apparatus configured to form an image on a sheet.

Description of the Related Art

In general, there has been known a printer including a guide member provided on an upstream side of a nip of a pair of conveyance rollers in a conveyance direction to guide a sheet to the nip. In order to prevent the sheet to be guided to the nip by the guide member from being brought into abutment against a portion other than the nip of the pair of conveyance rollers and causing increase in conveyance resistance or occurrence of paper jam, a leading edge of the guide member is arranged close to the nip. However, when the leading edge of the guide member is arranged close to the nip, there is a fear in that the sheet being conveyed and the leading edge of the guide member are brought into slide contact with each other even after a leading edge of the sheet enters the nip. As a result, when an image is printed on the sheet, the image on the sheet rubs against the leading edge of the guide member so that the image suffers scratches. Thus, image quality is degraded.

Hitherto, there has been proposed a printer system including a guide configured to guide a sheet to a nip portion of a curl correction roller pair configured to correct a curl of the sheet (Japanese Patent Application Laid-Open No. 2017-141092). In the printer system, control for adjusting a posture of the sheet through adjustment of an amount of correction by the curl correction roller pair is performed to prevent a surface of the sheet and the guide from rubbing against each other.

However, a posture of the sheet that is to be conveyed by the printer system described in Japanese Patent Application Laid-Open No. 2017-141092 is not stabilized due to, for example, heat of a fixing device. Moreover, the posture of the sheet is also changed due to a wear amount of the curl correction roller pair. Accordingly, even when the control of adjusting the amount of correction by the curl correction roller pair is performed, the posture of the sheet cannot be changed to prevent the sheet and the guide from rubbing against each other. As a result, quality of the image on the sheet is degraded in some cases.

SUMMARY OF THE INVENTION

According to one embodiment of the present invention, there is provided an image forming apparatus, comprising:

an image forming portion configured to form an image on a sheet;

a pair of conveyance rotary members, which is arranged downstream of the image forming portion in a sheet conveyance direction, and is configured to convey the sheet, on which the image is formed by the image forming portion, by a conveyance nip; and a guide portion configured to guide the sheet, on which the image is formed by the image forming portion, to the conveyance nip, the guide portion including:

a first guide member, which is formed into a sheet shape, has a first stiffness, and includes an abutment surface configured to abut against the sheet; and a second guide member, which is formed into a sheet shape, has a second stiffness higher than the first stiffness, and is arranged on a side opposite to the abutment surface of the first guide member, wherein a downstream edge of the first guide member in the sheet conveyance direction is arranged closer to the conveyance nip than a downstream edge of the second guide member in the sheet conveyance direction.

Further features of the present invention will become apparent from the following description of exemplary embodiments with reference to the attached drawings.

DESCRIPTION OF THE EMBODIMENTS

First Embodiment

[Overall Configuration]

Figure 1:
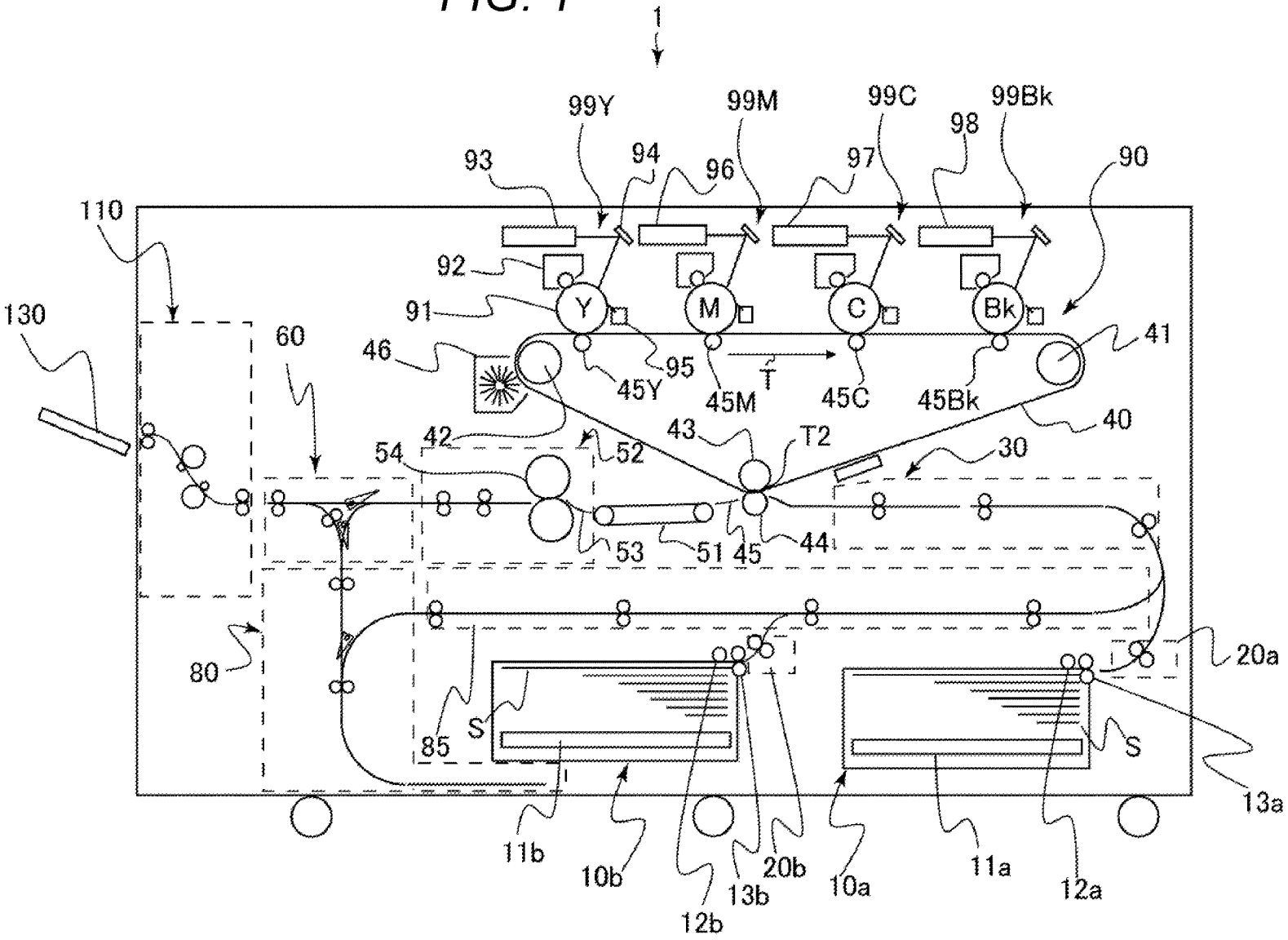
FIG. 1 is an overall schematic view for illustrating a printer according to a first embodiment of the present invention.

First, a first embodiment of the present invention is described. A printer 1 serving as an image forming apparatus is an electrophotographic full-color laser beam printer. As illustrated in FIG. 1, the printer 1 includes feeding units 10*a* and 10*b*, draw-out units 20*a* and 20*b*, a registration unit 30, an image forming unit 90, a fixing unit 52, and a branching conveyance unit 60. The printer 1 further includes a decurl unit 110, a reversing conveyance unit 80, and a double-sided conveyance unit 85.

The image forming unit 90 includes four process cartridges 99Y, 99M, 99C, and 99Bk and exposure devices 93, 96, 97, and 98. The four process cartridges 99Y, 99M, 99C, and 99Bk are configured to respectively form toner images of four colors, that is, yellow (Y), magenta (M), cyan (C), and black (K). The four process cartridges 99Y, 99M, 99C, and 99Bk have the same configuration except that the four process cartridges 99Y, 99M, 99C, and 99Bk form images of different colors. Accordingly, a configuration and an image forming process of only the process cartridge 99Y are described, and description of the process cartridges 99M, 99C, and 99Bk is omitted.

The process cartridge 99Y includes a photosensitive drum 91, a charging roller (not shown), a developing device 92, and a cleaner 95. The photosensitive drum 91 is formed by applying an organic photoconductive layer on an outer periphery of an aluminum cylinder, and is rotated by a drive motor (not shown). Further, the image forming unit 90 includes an intermediate transfer belt 40 that is rotated by a drive roller 42 in a direction indicated by the arrow T. The intermediate transfer belt 40 is wound around a tension roller 41, the drive roller 42, and a secondary transfer inner roller 43. Primary transfer rollers 45Y, 45M, 45C, and 45Bk are provided on an inner side of the intermediate transfer belt 40, and a secondary transfer outer roller 44 is provided on an outer side of the intermediate transfer belt 40 so as to be opposed to the secondary transfer inner roller 43.

The fixing unit 52 includes a fixing roller pair 54 and a before-fixing guide 53. The before-fixing guide 53 is configured to guide a sheet to a nip of the fixing roller pair 54. The feeding unit 10*a* includes a lift plate 11 a, a pickup roller 12*a*, and a separation roller pair 13*a*. The lift plate 11*a* rises and lowers with sheets S stacked thereon. The pickup roller 12*a* is configured to feed the sheets S stacked on the lift plate 11 a. The separation roller pair 13*a* is configured to separate the fed sheets one by one. Similarly, the feeding unit 10*b* includes a lift plate 11*b*, a pickup roller 12*b*, and a separation roller pair 13*b*. The lift plate 11*b* rises and lowers with the sheets S stacked thereon. The pickup roller 12*b* is configured to feed the sheets S stacked on the lift plate 11*b*. The separation roller pair 13*b* is configured to separate the fed sheets one by one.

Next, description is made of an image forming operation of the printer 1 configured as described above. When an image signal is input to the exposure device 93 from an external apparatus such as a personal computer (not shown), laser light corresponding to the image signal is emitted from the exposure device 93 so that the photosensitive drum 91 of the process cartridge 99Y is irradiated with the laser light.

At this time, a surface of the photosensitive drum 91 is uniformly charged to predetermined polarity and electric potential by the charging roller in advance. Through irradiation of the photosensitive drum 91 with the laser light emitted from the exposure device 93 via a mirror 94, an electrostatic latent image is formed on the surface of the photosensitive drum 91. The electrostatic latent image formed on the photosensitive drum 91 is developed by the developing device 92 with developer (toner). Thus, a toner image of yellow (Y) is formed on the photosensitive drum 91.

Similarly, the respective photosensitive drums of the exposure devices 96, 97, and 98 are also irradiated with laser light emitted from the process cartridges 99M, 99C, and 99Bk, and thus toner images of magenta (M), cyan (C), and black (K) are formed on the respective photosensitive drums. The toner images of respective colors formed on the respective photosensitive drums are transferred onto the intermediate transfer belt 40 by the primary transfer rollers 45Y, 45M, 45C, and 45Bk. Then, a full-color toner image is conveyed to a secondary transfer nip T2 formed between the secondary transfer inner roller 43 and the secondary transfer outer roller 44 by the intermediate transfer belt 40 rotated by the drive roller 42. The toner remaining on the photosensitive drum 91 is collected by the cleaner 95. An image forming process for each color is performed at a timing of superposing a toner image onto an upstream toner image primarily transferred onto the intermediate transfer belt 40.

In parallel with this image forming process, the sheet S is fed from any one of the feeding units 10*a* and 10*b*, and then is conveyed to the registration unit 30 by any one of the draw-out units 20*a* and 20*b*. Skew feed of the sheet S is corrected by the registration unit 30, and then is conveyed at a predetermined conveyance timing to the secondary transfer nip T2 being the image forming portion. Onto a first sheet surface (front surface) of the sheet S, the full-color toner image on the intermediate transfer belt 40 is transferred by a secondary transfer bias applied to the secondary transfer outer roller 44. The residual toner remaining on the intermediate transfer belt 40 is collected by a belt cleaner 46.

The sheet S on which the toner image is transferred is conveyed to the fixing unit 52 by an after-transferring guide 45 and a before-fixing conveyance portion 51. Then, the sheet S is guided by the before-fixing guide 53 to a nip of the fixing roller pair 54. At the nip of the fixing roller pair 54, predetermined heat and pressure are applied to the sheet S so that the toner is melted to adhere (is fixed) to the sheet. For the sheet S having passed through the fixing unit 52, path selection is performed by the branching conveyance unit 60 between conveyance to the decurl unit 110 and conveyance to the reversing conveyance unit 80. After the sheet S is conveyed to the reversing conveyance unit 80, the sheet S can be reversed so that the first sheet surface on which the image is formed at the secondary transfer nip T2 is directed downward, and the sheet S can be conveyed to the decurl unit 110.

When an image is to be formed only on one surface of the sheet S, the sheet S is conveyed from the branching conveyance unit 60 to the decurl unit 110 so that a curl of the sheet is corrected by a hard roller having a small diameter and a soft roller having a large diameter. An amount of correction of the curl can be adjusted by changing an extending amount of the hard roller into the soft roller. The sheet S having passed through the decurl unit 110 is delivered to a delivery tray 130.

When an image is to be formed on both surfaces of the sheet S, the sheet S is conveyed by the branching conveyance unit 60 to the reversing conveyance unit 80, and is switched back at the reversing conveyance unit 80. The sheet S having been switched back is conveyed from the reversing conveyance unit 80 to the double-sided conveyance unit 85, and is guided to the registration unit 30. After that, an image is formed on a second sheet surface (back surface) of the sheet S at the secondary transfer nip T2, and the sheet is delivered from the decurl unit 110 to the delivery tray 130.

[Configurations of Branching Conveyance Unit and Reversing Conveyance Unit]

Figure 2:
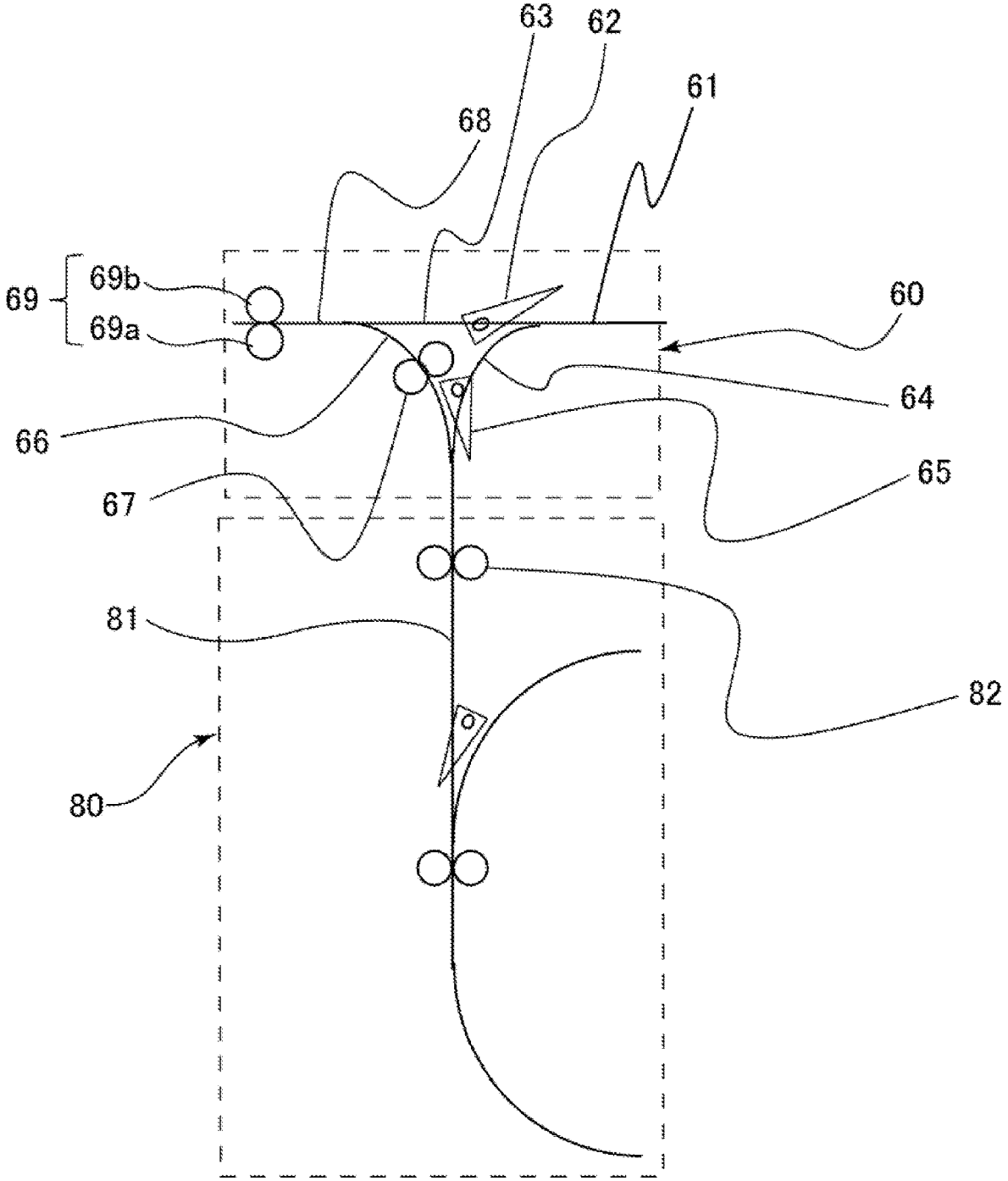
FIG. 2 is a schematic view for illustrating a branching conveyance unit and a reversing conveyance unit.
Figure 3:
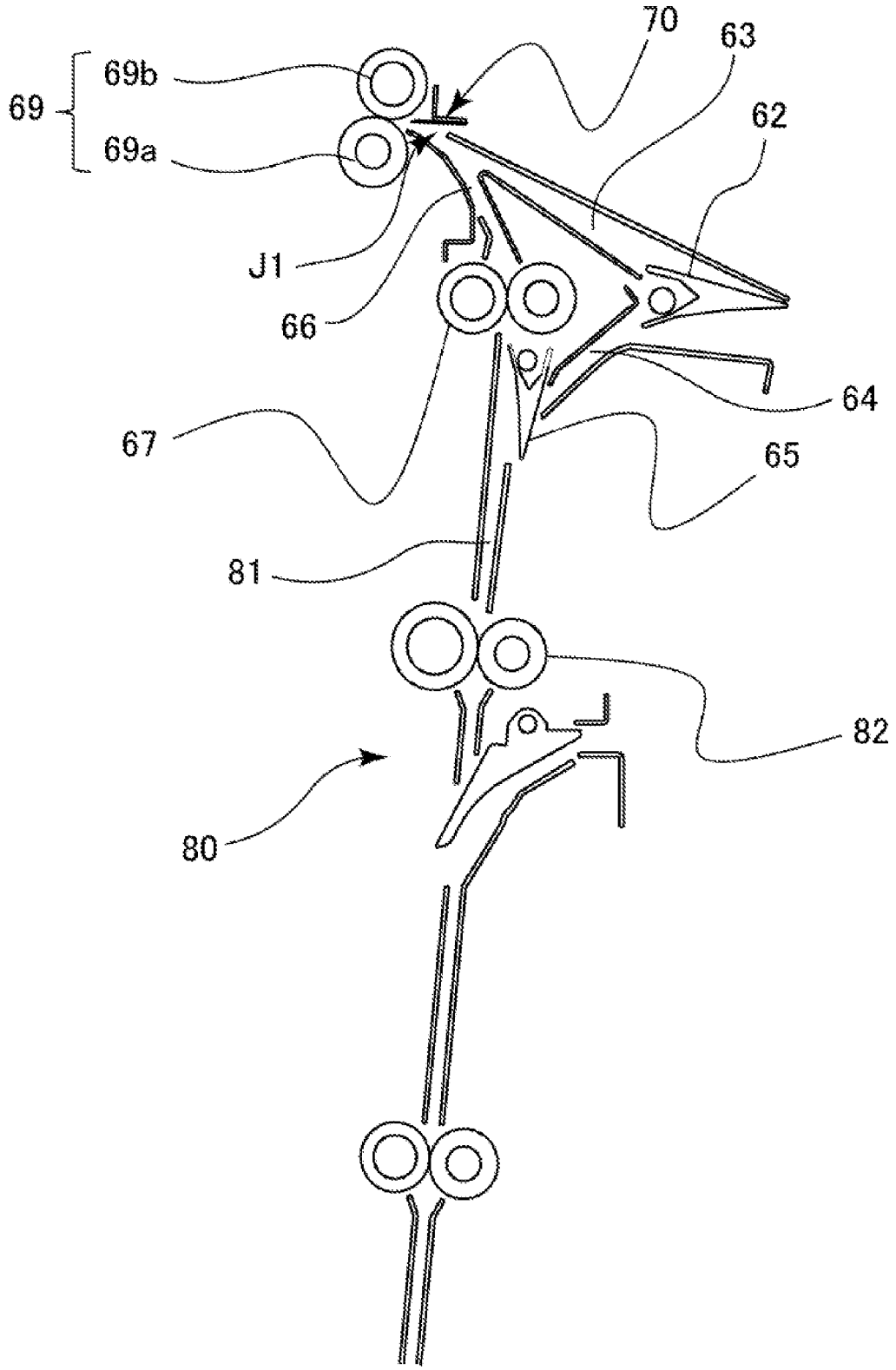
FIG. 3 is a sectional view for illustrating the branching conveyance unit and the reversing conveyance unit.

Next, description is made of configurations of the branching conveyance unit 60 and the reversing conveyance unit 80. As illustrated in FIG. 2 and FIG. 3, the branching conveyance unit 60 includes an inlet conveyance path 61 and a straight conveyance path 63. The inlet conveyance path 61 is configured to guide the sheet S conveyed by the fixing unit 52. The straight conveyance path 63 extends straight and continues from the inlet conveyance path 61. Further, the branching conveyance unit 60 includes a reversing merging path 68 and a before-reversing conveyance path 64. The reversing merging path 68 extends straight and continues from the straight conveyance path 63. The before-reversing conveyance path 64 branches from a downstream end of the inlet conveyance path 61 in a sheet conveyance direction to extend in a direction different from an extending direction of the straight conveyance path 63. Further, the branching conveyance unit 60 includes a reversing conveyance path 81 and an after-reversing conveyance path 66. The reversing conveyance path 81 extends downward from the before-reversing conveyance path 64. The after-reversing conveyance path 66 connects the reversing conveyance path 81 and the reversing merging path 68 to each other.

At a branch portion between the straight conveyance path 63 and the before-reversing conveyance path 64, a first switching member 62 is provided. The first switching member is configured to be capable of switching guiding of the sheet S that passes through the inlet conveyance path 61 between a position of guiding the sheet to the straight conveyance path 63 and a position of guiding the sheet to the before-reversing conveyance path 64. At a branch portion between the before-reversing conveyance path 64 and the after-reversing conveyance path 66, a second switching member 65 is provided. The second switching member 65 is urged in a state of being positioned by an urging member (not shown) so as to guide, to the after-reversing conveyance path 66, the sheet S that passes through the reversing conveyance path 81. When the sheet S is conveyed from the inlet conveyance path 61 to the before-reversing conveyance path 64, against an urging force of the urging member, the sheet S advances to the reversing conveyance path 81 while pressing the second switching member 65.

Figure 4A:
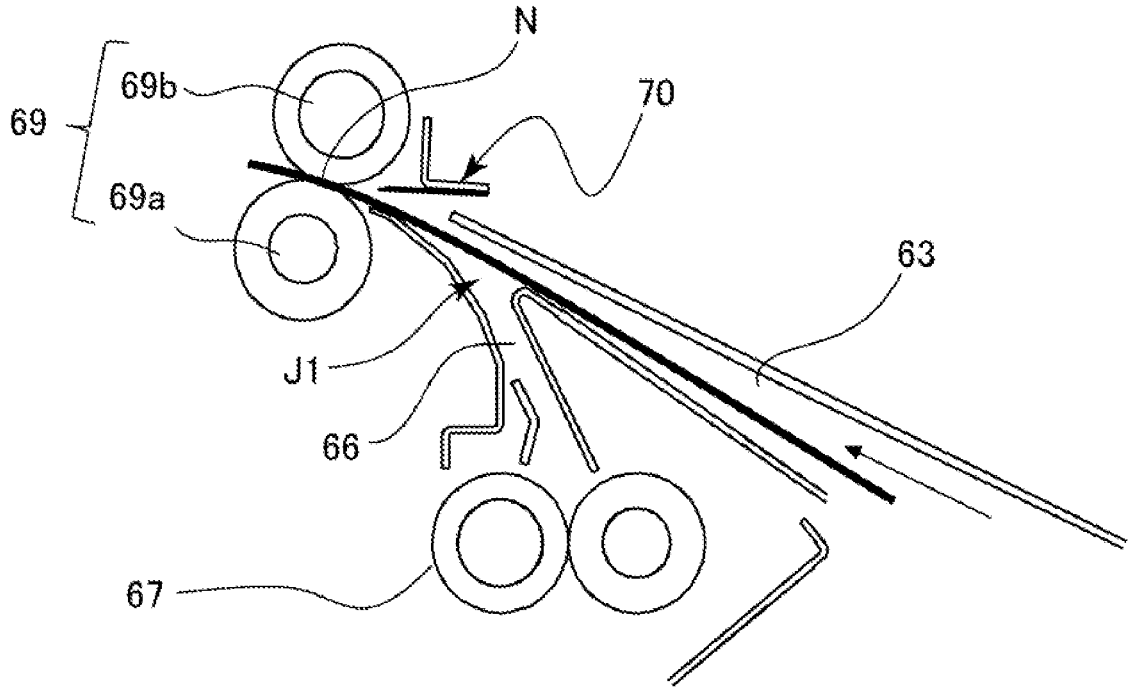
FIG. 4A is a schematic view for illustrating a course of a sheet subjected to a face up conveyance.

A reverse roller pair 82 is provided in the reversing conveyance path 81. The reverse roller pair 82 is forwardly and reversely rotatable, and is configured to be capable of switching back the sheet S. A before-delivering roller pair 67 is provided in the after-reversing conveyance path 66. The before-delivering roller pair 67 is configured to convey the sheet S toward the reversing merging path 68. A delivery roller pair 69 serving as a pair of conveyance rotary members is provided in the reversing merging path 68. The delivery roller pair 69 is configured to deliver the sheet S toward the decurl unit 110 (see FIG. 1). The delivery roller pair 69 includes a drive roller 69*a* and a driven roller 69*b*. The drive roller 69*a* includes an elastic layer formed of a rubber member made of, for example, silicone, and is driven by a drive source (not shown). The driven roller 69*b* includes a resin layer formed of a resin member made of, for example, polyoxymethylene (POM), and is driven and rotated by the drive roller 69*a*. The drive roller 69*a* and the driven roller 69*b* form a nip portion N (FIG. 4A). Each of the elastic layer of the drive roller 69*a* and the resin layer of the driven roller 69*b* is formed of a single member, and has a length greater in a width direction orthogonal to the sheet conveyance direction of the sheet that is usable in the printer 1 than a maximum length of the sheet in the width direction.

Further, each of the reverse roller pair 82 and the before-delivering roller pair 67 has a length greater in the width direction than the maximum length in the width direction of the sheet that usable in the printer 1. With this, even under a state in which the toner to which heat and pressure are applied by the fixing unit 52 is not cured or fixed on the sheet S, uneven glossiness of the image on the sheet S can be reduced.

In a case of performing so-called face up conveyance, that is, conveyance of the sheet S to the decurl unit 110 so that the first sheet surface on which the image is formed at the secondary transfer nip T2 is directed upward, the sheet S takes the following course. That is, the sheet S passes through the inlet conveyance path 61, the straight conveyance path 63, and the reversing merging path 68, and is conveyed to the decurl unit 110. In a case of performing so-called face down conveyance, that is, conveyance of the sheet S to the decurl unit 110 so that the first sheet surface on which the image is formed at the secondary transfer nip T2 is directed downward, the sheet S takes the following course. That is, the sheet S passes through the inlet conveyance path 61, the before-reversing conveyance path 64, the reversing conveyance path 81, the after-reversing conveyance path 66, and the reversing merging path 68, and is conveyed to the decurl unit 110.

[Configuration of Guide Unit]

Figure 4B:
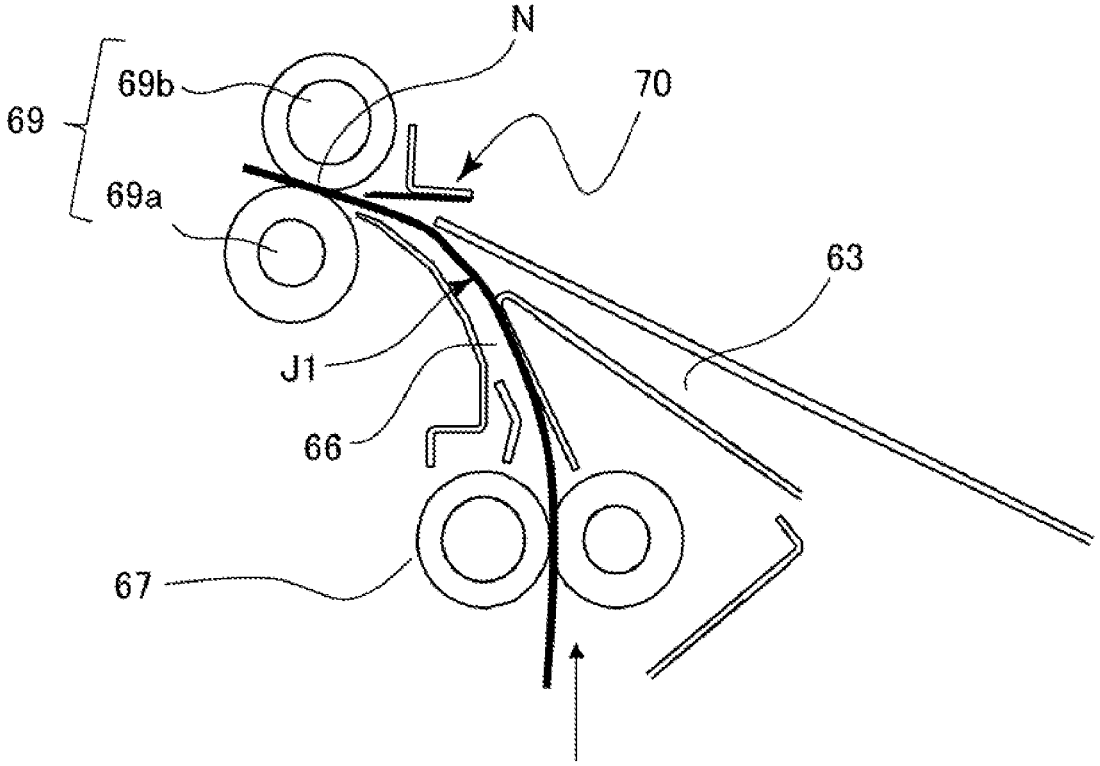
FIG. 4B is a schematic view for illustrating a course of a sheet subjected to a face down conveyance.

Next, description is made of a configuration of a guide unit 70. Both in the case of performing a face up conveyance of the sheet S as illustrated in FIG. 4A, and the case of performing a face down conveyance of the sheet S as illustrated in FIG. 4B, the sheet S passes through the nip portion N of the delivery roller pair 69. In the case of the face up conveyance, the sheet S passes a straight course, and does not significantly change its posture. However, in the case of the face down conveyance, the sheet S significantly changes the posture so as to be curved in the after-reversing conveyance path 66. Thus, when the posture of the sheet S is not stabilized so that a leading edge of the sheet S is brought into abutment against, for example, an outer peripheral surface of the driven roller 69*b*, damage such as a crease may occur on the sheet S or paper jam may occur.

Accordingly, in the first embodiment, in order to reliably guide the leading edge of the sheet S to the nip portion N, in a vicinity of a merging portion J1 of the straight conveyance path 63 and the after-reversing conveyance path 66, the guide unit 70 is provided. At a location such as the merging portion J1 at which two conveyance paths merge with each other, the sheet S is liable to be curved. Thus, it is required to more precisely guide the leading edge of the sheet S to the nip portion N.

Figure 5:
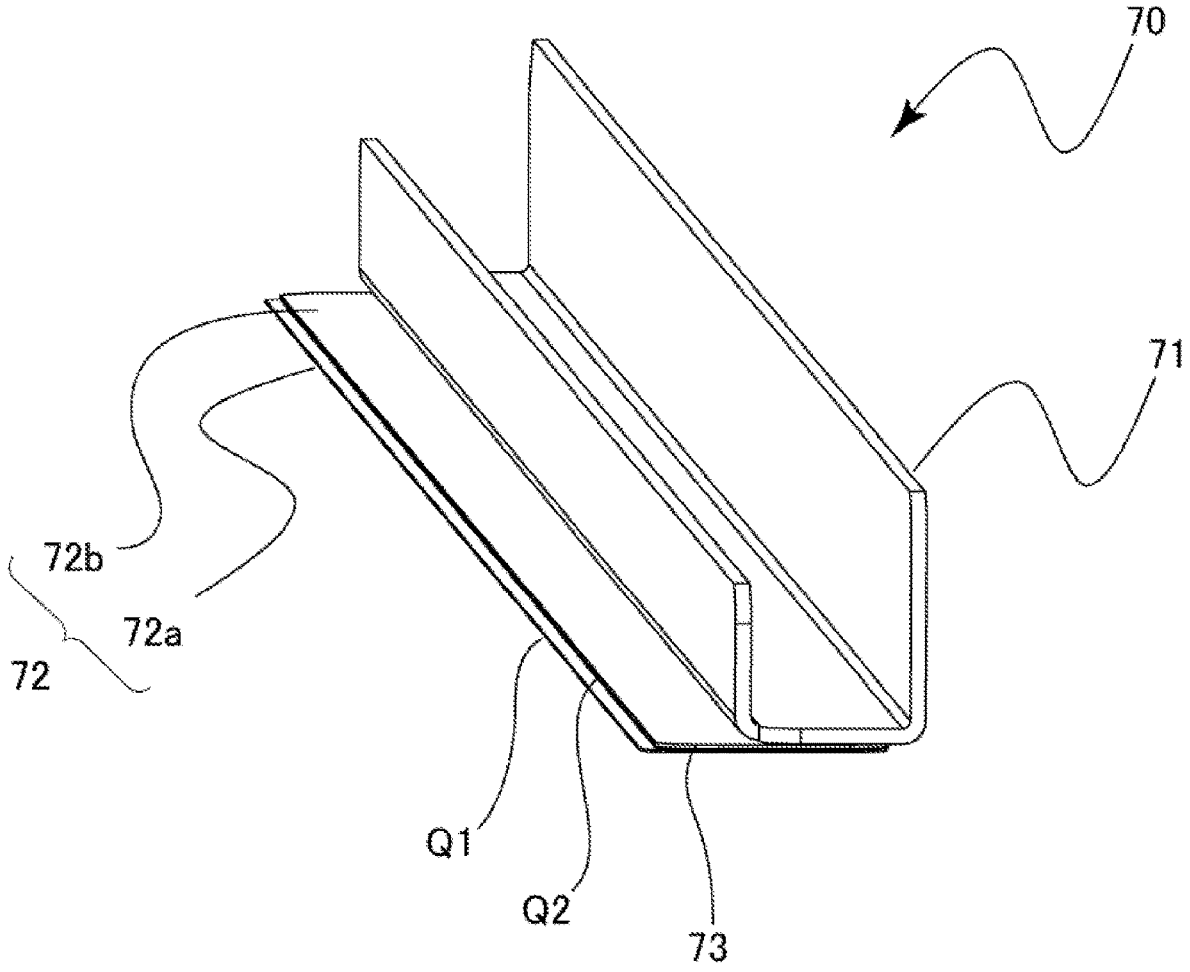
FIG. 5 is a perspective view for illustrating a guide unit.
Figure 6:
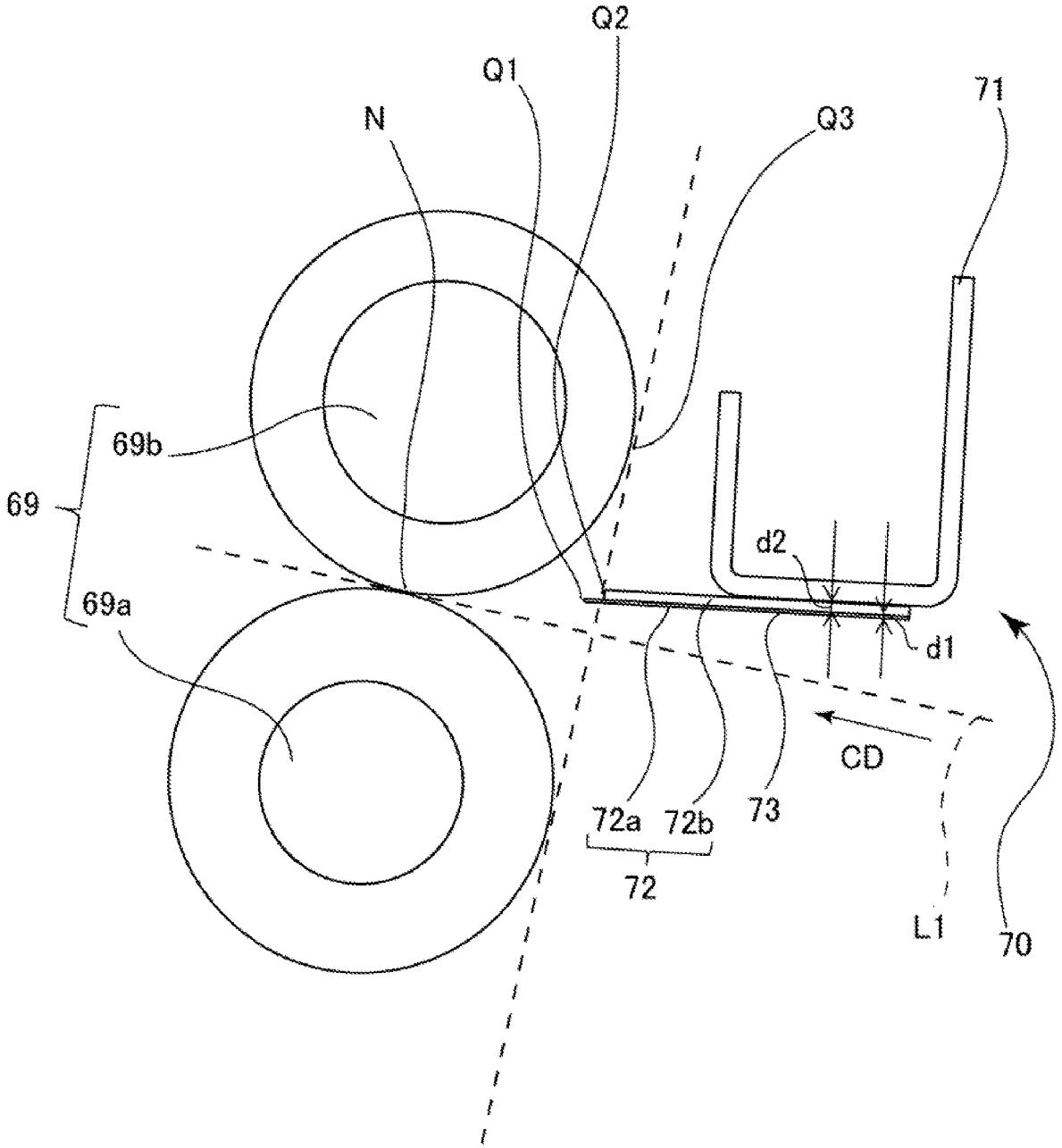
FIG. 6 is a sectional view for illustrating the guide unit and a delivery roller pair.

As illustrated in FIG. 5 and FIG. 6, the guide unit 70 includes a support member 71 and a guide portion 72 supported on the support member 71. The support member 71 is formed of, for example, a metal sheet having a U-shaped cross section. The guide portion 72 includes a first elastic sheet member 72*a* and a second elastic sheet member 72*b*. The first elastic sheet member 72*a* serves as a first guide member. The second elastic sheet member 72*b* serves as a second guide member. The first elastic sheet member 72*a* includes an abutment surface 73 capable of being brought into abutment against the sheet S. In particular, when the face up conveyance of the sheet S is performed or when duplex printing is performed on the sheet S, the abutment surface 73 is opposed to an image forming surface of the sheet S on which an image is formed, and thus can be brought into abutment against the sheet S. The second elastic sheet member 72*b* is bonded to a surface of the first elastic sheet member 72*a* opposite to the abutment surface 73, and is fixed to the support member 71 through, for example, adhesive bonding. It is not always required that the second elastic sheet member 72*b* be bonded directly to the first elastic sheet member 72*a*, and a separate member may be interposed between the first elastic sheet member 72*a* and the second elastic sheet member 72*b*.

The first elastic sheet member 72*a* is formed into a sheet shape, and has a first stiffness. The second elastic sheet member 72*b* is formed into a sheet shape, and has a second stiffness higher than the first stiffness. The first elastic sheet member 72*a* and the second elastic sheet member 72*b* are each made of, for example, polyethylene terephthalate (PET). As illustrated in FIG. 6, a thickness d1 of the first elastic sheet member 72*a* is smaller than a thickness d2 of the second elastic sheet member 72*b*. The first elastic sheet member 72*a* and the second elastic sheet member 72*b* each have a thickness smaller than a thickness of the guide member formed of, for example, a metal sheet, and hence are easily provided to be close to the nip portion N.

The first elastic sheet member 72*a* has a thickness of from 30 [μm] to 100 [μm], and it is preferred that the first elastic sheet member 72*a* have a thickness of about 50 [μm]. The second elastic sheet member 72*b* has a thickness of from 150 [μm] to 400 [μm]. Further, each of the first elastic sheet member 72*a* and the second elastic sheet member 72*b* is formed of a rectangular PET sheet in view of high processability, but may have a shape other than a rectangular shape. In order to increase ability of slide contact of the abutment surface 73 of the first elastic sheet member 72*a*, a coating may be applied to the abutment surface 73.

In addition, a downstream edge Q1 of the first elastic sheet member 72*a* in a sheet conveyance direction CD is closer to the nip portion N than a downstream edge Q2 of the second elastic sheet member 72*b*, and projects downstream of the support member 71 in the sheet conveyance direction CD as compared to the downstream edge Q2. Further, the downstream edge Q1 of the first elastic sheet member 72*a* is located downstream of an upstream end position Q3 of the delivery roller pair 69 in the sheet conveyance direction at the nip portion N, that is, in the sheet conveyance direction CD parallel to a nip line L1. The guide portion 72 is arranged so as to be prevented from intersecting with the nip line L1 that is a common tangent of the drive roller 69*a* and the driven roller 69*b* at the nip portion N. With this, the image forming surface is less liable to be damaged by the abutment surface 73.

As described above, in the first embodiment, the leading edge of the sheet S is reliably guided to the nip portion N by the guide portion 72 including the first elastic sheet member 72*a* and the second elastic sheet member 72*b* that have different stiffnesses. In this manner, damage to the sheet S and occurrence of paper jam are prevented. In particular, when the sheet S having high stiffness such as cardboard is conveyed, not only the first elastic sheet member 72*a* having low stiffness but also the second elastic sheet member 72*b* having high stiffness receives a force applied from the sheet S. Accordingly, significant deformation of the guide portion 72 due to the force applied from the sheet S, and reduction of guiding accuracy of the leading edge of the sheet S can be prevented.

[Behavior of Curled Sheet]

Figure 7A:
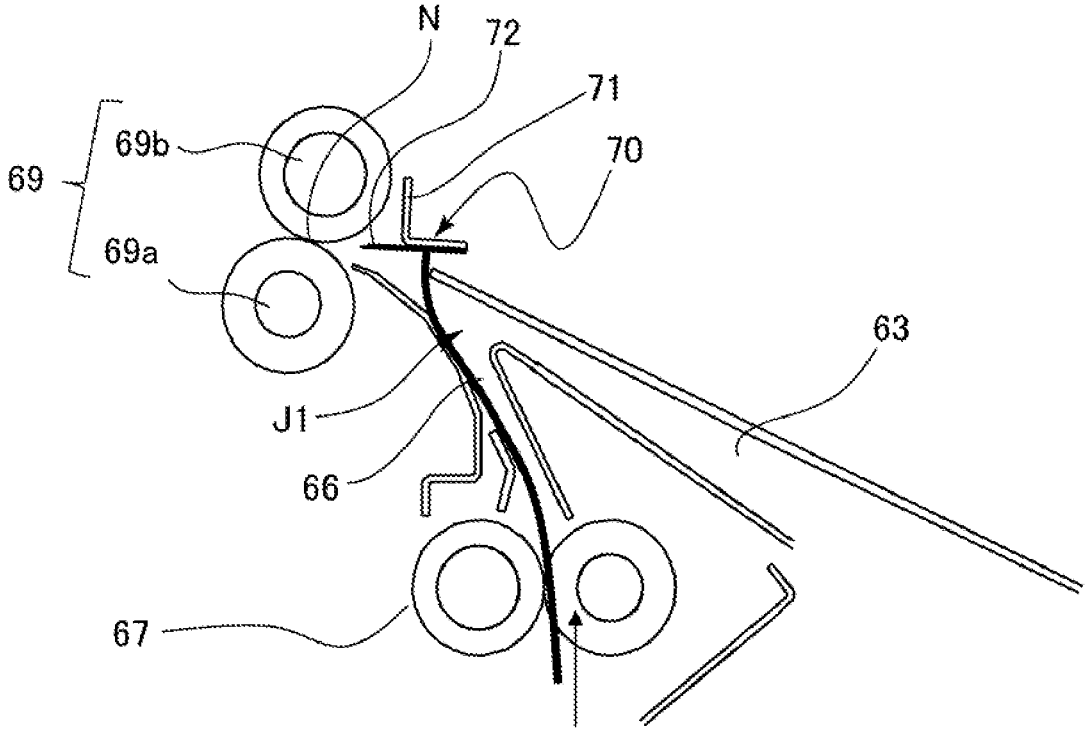
FIG. 7A is a sectional view for illustrating a state in which a curled sheet is conveyed so that a leading edge of the sheet is brought into abutment against the guide unit.

Next, description is made of behavior of the sheet S when the guide unit 70 guides the curled sheet S. An impact applied to the guide unit 70 from the sheet S is maximum when, as illustrated in FIG. 7A, the sheet S passes through the after-reversing conveyance path 66 and is curled to be brought into abutment against the guide unit 70. In this case, in particular, in a case in which the sheet is a sheet having high stiffness such as cardboard, when only the guide portion 72 receives the impact from the sheet S, the guide portion 72 is significantly bent, with the result that there is a fear in that the leading edge of the sheet S cannot be guided to the nip portion N. Accordingly, the support member 71 of the guide unit 70 is arranged at such a position as to be capable of receiving the impact from the sheet S. With this, the sheet S can be reliably guided to the nip portion N. Further, the guide portion 72 is arranged closer to the merging portion J1 than the support member 71. Thus, owing to a force of pressing the guide portion 72 by the sheet S, the guide portion 72 is less liable to be peeled off from the support member 71.

Figure 7B:
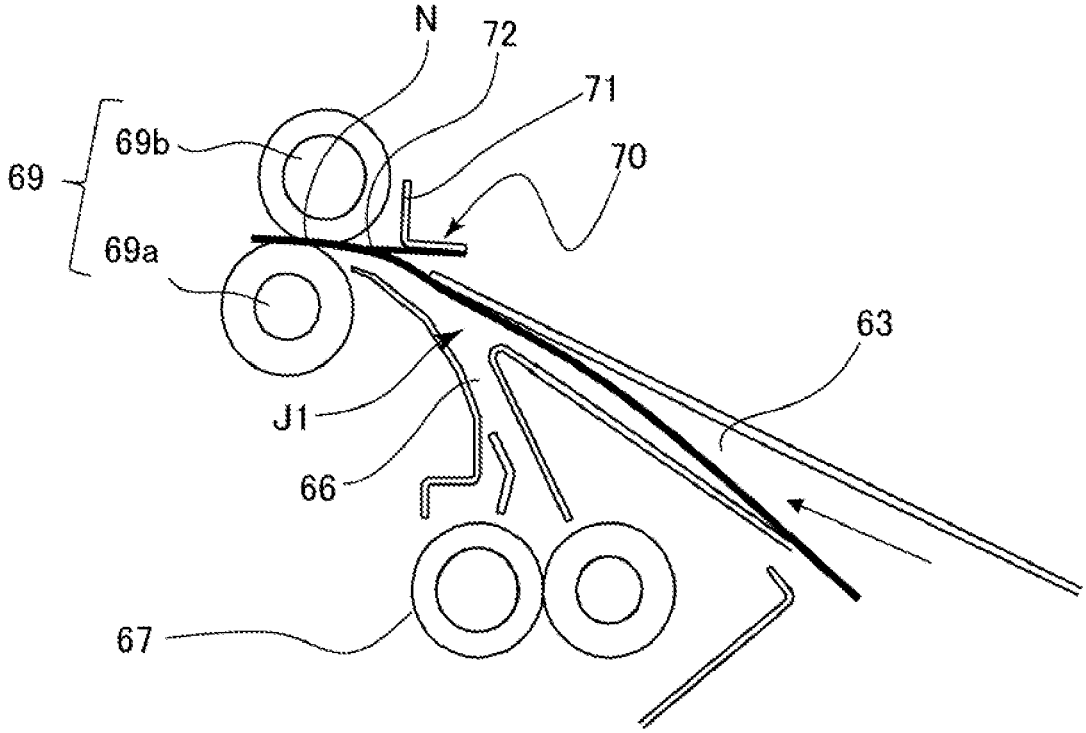
FIG. 7B is a sectional view for illustrating a state in which a curled sheet is conveyed so that a surface of the sheet is brought into slide contact with the guide unit.

As illustrated in FIG. 7B, when the sheet S passes through the straight conveyance path 63 and is curled upward, the sheet S is prone to be brought into contact with the guide portion 72. In the first embodiment, as illustrated in FIG. 6, the guide portion 72 includes the first elastic sheet member 72*a* and the second elastic sheet member 72*b*. Moreover, the first elastic sheet member 72*a* and the second elastic sheet member 72*b* are bonded to each other to allow the sheet S to be brought into abutment against the first elastic sheet member 72*a*. Further, the downstream edge Q1 of the first elastic sheet member 72*a* is provided closer to the nip portion N than the downstream edge Q2 of the second elastic sheet member 72*b*.

Accordingly, the downstream edge Q1 of the first elastic sheet member 72*a* is prone to be brought into slide contact with the curled sheet S, but the stiffness of the first elastic sheet member 72*a* is lower than the stiffness of the second elastic sheet member 72*b*. Thus, the first elastic sheet member 72*a* is elastically deformed easily by being pressed by the sheet S. Further, the sheet S is not brought into slide contact with the downstream edge Q2 of the second elastic sheet member 72*b* having relatively high stiffness. Therefore, pressure applied from the guide portion 72 to the sheet S can be reduced. As a result, formation of scratches on the image printed on the sheet S can be reduced, and degradation of image quality can be suppressed.

As described above, the guide portion 72 includes two elastic sheet members that are bonded to each other and differ in position of the downstream edge and stiffness (thickness). With this configuration, irrespective of a kind and a posture of the sheet, the sheet S can be reliably guided to the nip portion N of the delivery roller pair 69 provided close to the merging portion J1. Further, formation of scratches on the image of the sheet can be reduced, and degradation of image quality can be suppressed.

According to the first embodiment, the guide portion 72 configured to guide the sheet to the nip portion (conveyance nip) N includes the first elastic sheet member (first guide member) 72*a* and the second elastic sheet member (second guide member) 72*b* having different stiffnesses. According to the first embodiment, irrespective of a kind and a posture of the sheet, formation of scratches on the image of the sheet can be reduced, and degradation of image quality can be suppressed.

Second Embodiment

Next, description is made of a second embodiment of the present invention. In the second embodiment, the guide unit in the first embodiment is arranged in the decurl unit 110. Accordingly, regarding the same components as those of the first embodiment, illustration is omitted or description is made with reference to the drawings in which the same components are denoted by the same reference symbols.

Figure 8:
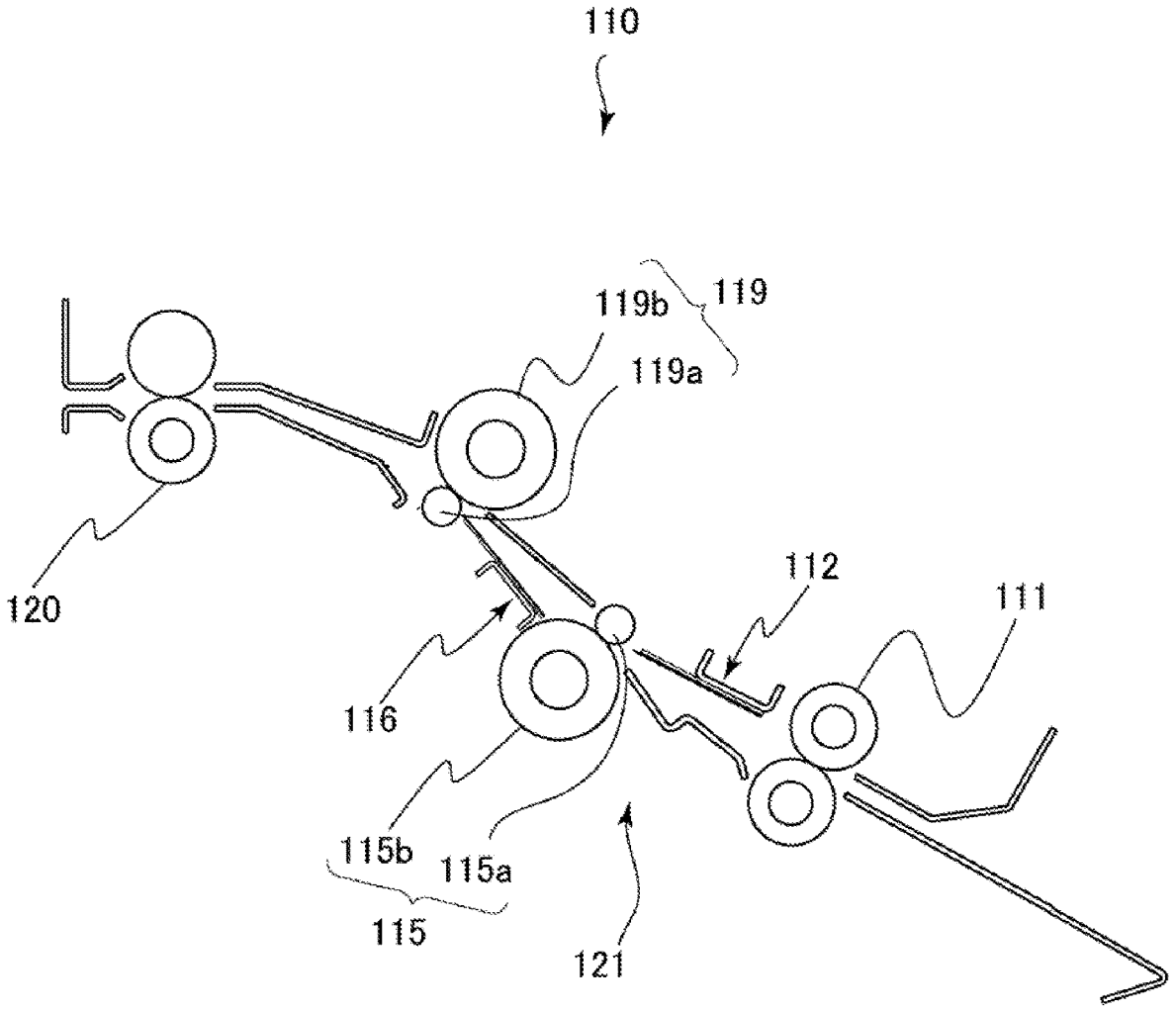
FIG. 8 is a sectional view for illustrating a decurl unit in a second embodiment of the present invention.

As illustrated in FIG. 8, the decurl unit 110 includes an upstream roller pair 111, a curl correction unit 121, and a downstream roller pair 120. The upstream roller pair 111 is configured to receive the sheet conveyed by the branching conveyance unit 60 (FIG. 1) to the decurl unit 110, and then convey the sheet to the curl correction unit 121. The curl correction unit 121 is configured to correct a curl of the sheet, and then convey the sheet to the downstream roller pair 120. The downstream roller pair 120 is configured to deliver the conveyed sheet to the delivery tray 130 (FIG. 1).

[Configuration of Curl Correction Unit]

Figure 9:
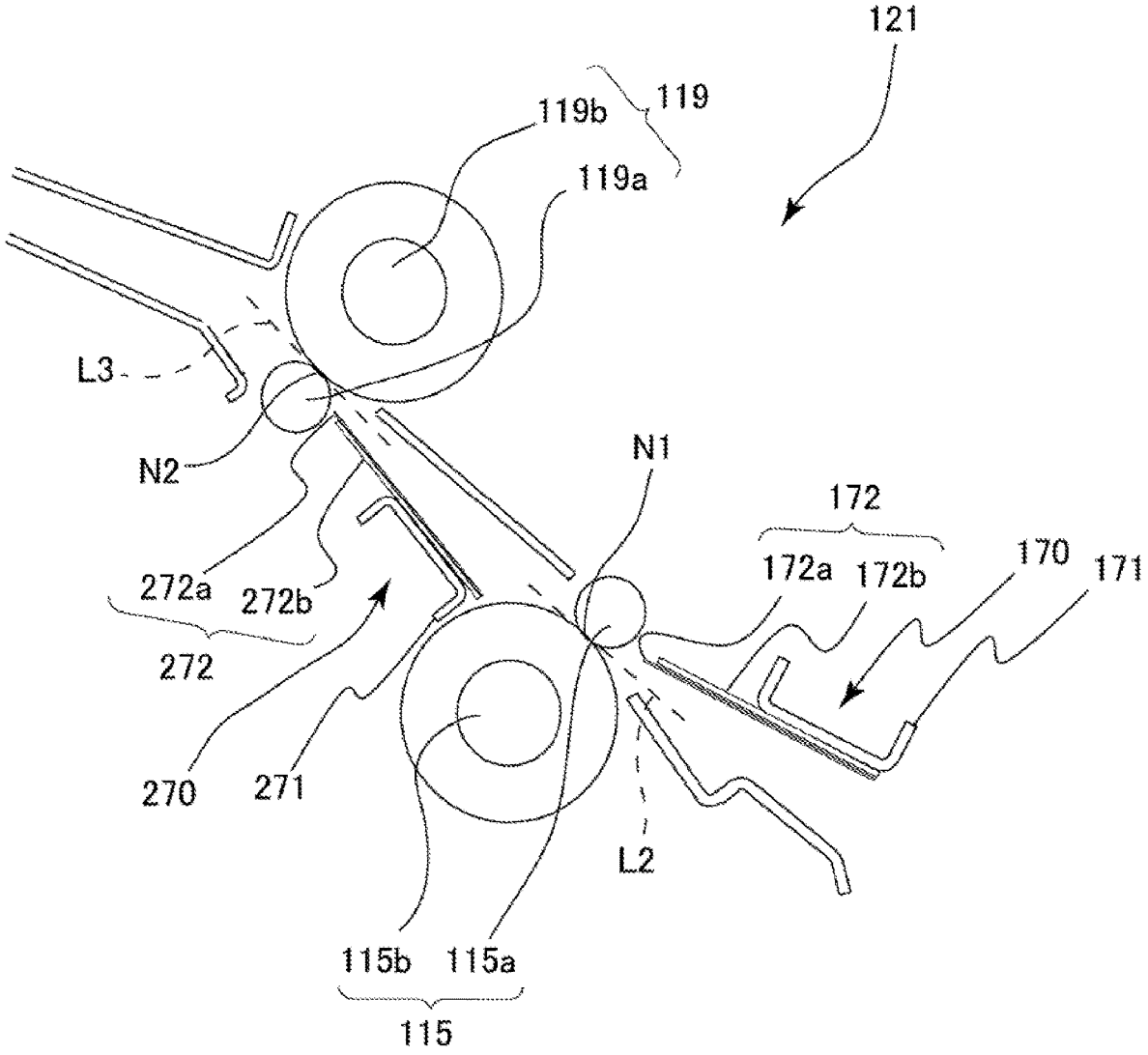
FIG. 9 is a sectional view for illustrating a curl correction unit.

As illustrated in FIG. 9, the curl correction unit 121 includes an upstream curl correction roller pair 115 and a downstream curl correction roller pair 119 each serving as a pair of conveyance rotary members. The upstream curl correction roller pair 115 includes an upstream metal roller 115*a* and an upstream sponge roller 115*b*. The upstream metal roller 115*a* is made of a metal material such as SUS, and serves as a first rotary member to be driven by a driver (not shown). The upstream sponge roller 115*b* is formed of a soft elastic member such as urethane foam. An outer diameter r2 of the upstream sponge roller 115*b* being a second outer diameter is larger than an outer diameter r1 of the upstream metal roller 115*a* being a first outer diameter (r2>r1). The upstream sponge roller 115*b* serving as the second rotary member is pressed against the upstream metal roller 115*a* by a cam member (not shown) so that a pressing force is variable in accordance with orientation of the curl and an amount of the curl.

The downstream curl correction roller pair 119 includes a downstream metal roller 119*a* and a downstream sponge roller 119*b*. The downstream metal roller 119*a* is made of a metal material such as SUS, and is to be driven by a driver (not shown). The downstream sponge roller 119*b* is formed of a soft elastic member such as urethane foam. An outer diameter r4 of the downstream sponge roller 119*b* is larger than an outer diameter r1 of the downstream metal roller 119*a* (r4>r3). The downstream sponge roller 119*b* is pressed against the downstream metal roller 119*a* by a cam member (not shown) so that a pressing force is variable in accordance with orientation of the curl and an amount of the curl.

The upstream curl correction roller pair 115 is arranged so that the image forming surface of the sheet subjected to the face up conveyance is opposed to the upstream metal roller 115*a*. Further, the downstream curl correction roller pair 119 is arranged so that the image forming surface of the sheet subjected to the face up conveyance is opposed to the downstream sponge roller 119*b*. That is, the upstream curl correction roller pair 115 and the downstream curl correction roller pair 119 are arranged in mutually inverted postures with respect to a conveyance path.

On an upstream side of the upstream curl correction roller pair 115 in the sheet conveyance direction, an upstream guide unit 170 is provided. The upstream guide unit 170 is configured to guide the sheet to a nip portion N1 of the upstream curl correction roller pair 115 being a conveyance nip. On an upstream side of the downstream curl correction roller pair 119 in the sheet conveyance direction, a downstream guide unit 270 is provided. The downstream guide unit 270 is configured to guide the sheet to a nip portion N2 of the downstream curl correction roller pair 119.

[Configurations of Upstream Guide Unit and Downstream Guide Unit]

The upstream guide unit 170 includes an upstream support member 171 and an upstream guide portion 172. The upstream support member 171 serves as a support member. The upstream guide portion 172 serves as a guide portion, and is supported on the upstream support member 171. The downstream guide unit 270 includes a downstream support member 271 and a downstream guide portion 272 supported on the downstream support member 271. The upstream guide unit 170 and the downstream guide unit 270 each have the same configuration as that of the guide unit 70 (see FIG. 6) described in the first embodiment.

That is, the upstream guide portion 172 includes an upstream first elastic sheet member 172*a* and an upstream second elastic sheet member 172*b*, and the upstream second elastic sheet member 172*b* is bonded to the upstream first elastic sheet member 172*a*. The upstream first elastic sheet member 172*a* and the upstream second elastic sheet member 172*b* are each made of, for example, polyethylene terephthalate (PET), and the upstream first elastic sheet member 172*a* serving as the first guide member is thinner than the upstream second elastic sheet member 172*b*. Accordingly, a stiffness of the upstream first elastic sheet member 172*a* is lower than that of the upstream second elastic sheet member 172*b* serving as the second guide member. In addition, the upstream first elastic sheet member 172*a* projects in a direction of approaching the nip portion N1 from the upstream support member 171 as compared to the upstream second elastic sheet member 172*b*. The upstream guide portion 172 is arranged on the same side as the upstream metal roller 115*a* with respect to a nip line L2 at the nip portion N1, and is arranged so as to be prevented from intersecting with the nip line L2.

Further, the downstream guide portion 272 includes a downstream first elastic sheet member 272*a* and a downstream second elastic sheet member 272*b*, and the downstream second elastic sheet member 272*b* is bonded to the downstream first elastic sheet member 272*a*. The downstream first elastic sheet member 272*a* and the downstream second elastic sheet member 272*b* are each made of, for example, polyethylene terephthalate (PET), and the downstream first elastic sheet member 272*a* is thinner than the downstream second elastic sheet member 272*b*. Accordingly, a stiffness of the downstream first elastic sheet member 272*a* is lower than that of the downstream second elastic sheet member 272*b*. In addition, the downstream first elastic sheet member 272*a* projects in a direction of approaching the nip portion N2 from the downstream support member 271 as compared to the downstream second elastic sheet member 272*b*. The downstream guide portion 272 is arranged on the same side as the downstream metal roller 119*a* with respect to a nip line L3 at the nip portion N2, and is arranged so as to be prevented from intersecting with the nip line L3.

[Behavior of Curled Sheet]

Figure 10A:
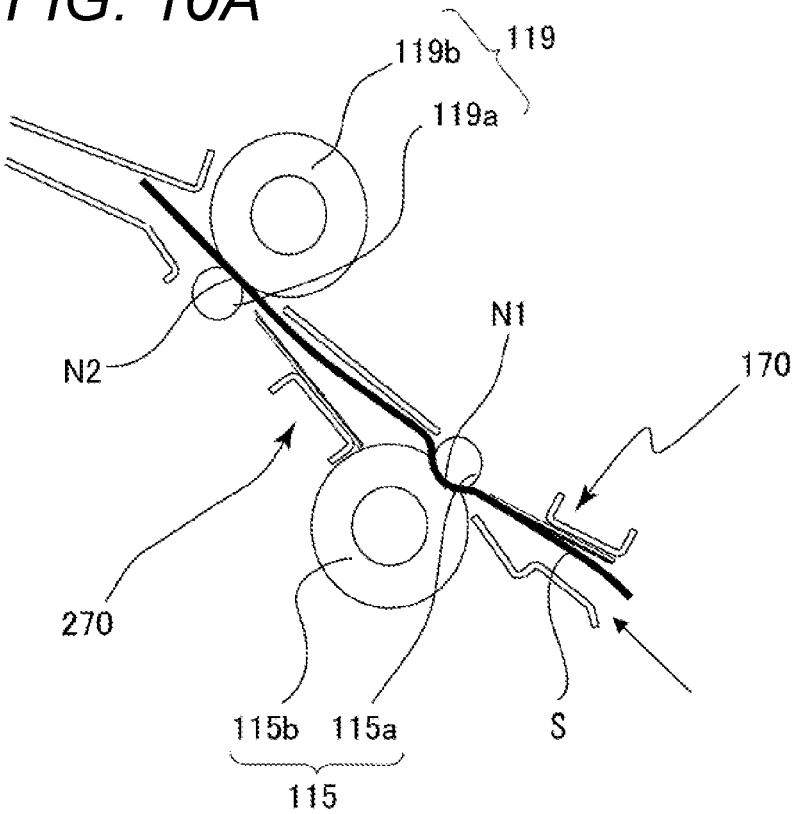
FIG. 10A is a sectional view for illustrating the curl correction unit under a state in which a downward curl of a sheet is corrected.

As illustrated in FIG. 10A, when the sheet S enters the decurl unit 110 under a state in which the sheet protrudes upward, that is, curled downward, control is performed so that the upstream sponge roller 115*b* is pressed against the upstream metal roller 115*a* to a large extent. At this time, the downstream curl correction roller pair 119 is controlled so as to have minimum nip pressure required for conveyance of the sheet S. When passing through the nip portion N1 of the upstream curl correction roller pair 115, the sheet S curled downward is drawn by the upstream metal roller 115*a* and the upstream sponge roller 115*b* so that the downward curl is corrected.

Figure 10B:
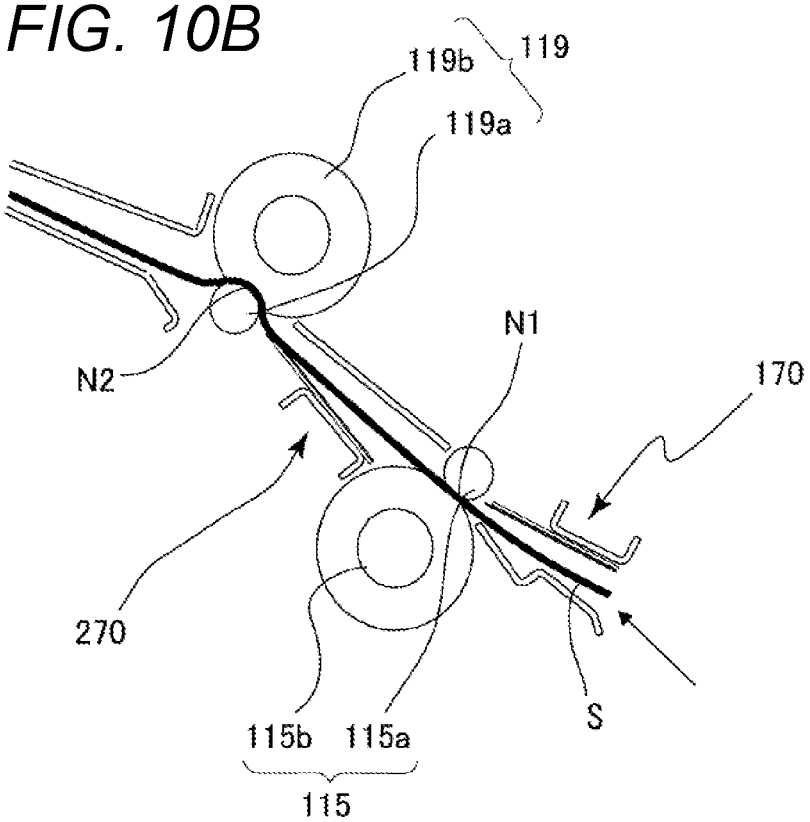
FIG. 10B is a sectional view for illustrating the curl correction unit under a state in which an upward curl of a sheet is corrected.

As illustrated in FIG. 10B, when the sheet S enters the decurl unit 110 under a state in which the sheet protrudes downward, that is, curled upward, control is performed so that the downstream sponge roller 119*b* is pressed against the downstream metal roller 119*a* to a large extent. At this time, the upstream curl correction roller pair 115 is controlled so as to have minimum nip pressure required for conveyance of the sheet S. When passing through the nip portion N2 of the downstream curl correction roller pair 119, the sheet S curled upward is drawn by the downstream metal roller 119*a* and the downstream sponge roller 119*b* so that the upward curl is corrected.

As described above, in order to correct the curl of the sheet, the pressing force of the upstream sponge roller 115*b* and the pressing force of the downstream sponge roller 119*b* change, and hence positions of the nip portions N1 and N2 also change. In addition, in order to improve curl correcting ability, the outer diameter of the upstream metal roller 115*a* is set smaller than that of the upstream sponge roller 115*b*, and the outer diameter of the downstream metal roller 119*a* is set smaller than that of the downstream sponge roller 119*b*. Accordingly, when the sheet S cannot be guided to the nip portion N1 or the nip portion N2 so that the leading edge of the sheet S collides with the upstream sponge roller 115*b* or the downstream sponge roller 119*b*, the sheet S may be damaged or paper jam may occur.

Further, in order to correct the curl, the sheet S is pressed by the upstream sponge roller 115*b* and the downstream sponge roller 119*b* at the nip portions N1 and N2, with the result that the posture of the sheet S changes. Accordingly, the sheet S is prone to be pressed against the upstream guide portion 172 of the upstream guide unit 170 and the downstream guide portion 272 of the downstream guide unit 270. At this time, when high pressure is applied to the sheet S from the upstream guide portion 172 and the downstream guide portion 272, scratches are formed on the image printed on the sheet S, and thus image quality is degraded.

However, in the second embodiment, each of the upstream guide portion 172 and the downstream guide portion 272 includes two elastic sheet members that are bonded to each other and differ in position of the downstream edge and stiffness (thickness). Accordingly, the pressure applied to the sheet S from the upstream guide portion 172 and the downstream guide portion 272 can be reduced. As a result, formation of scratches on the image printed on the sheet S can be reduced, and degradation of image quality can be suppressed.

According to the second embodiment, the upstream guide portion 172 configured to guide the sheet to the nip portion (conveyance nip) N1 includes the upstream first elastic sheet member (first guide member) 172*a* and the upstream second elastic sheet member (second guide member) 172*b* having different stiffnesses. Further, the downstream guide portion 272 configured to guide the sheet to the nip portion (conveyance nip) N2 includes the downstream first elastic sheet member (first guide member) 272*a* and the downstream second elastic sheet member (second guide member) 272*b* having different stiffnesses. According to the second embodiment, irrespective of a kind and a posture of the sheet, formation of scratches on the image of the sheet can be reduced, and degradation of image quality can be suppressed.

In any of the above-mentioned embodiments, the guide portion 72, the upstream guide portion 172, and the downstream guide portion 272 each include two sheet members that are made of the same material and differ in thicknesses, but the present invention is not limited thereto. For example, in the first embodiment, the first elastic sheet member 72*a* of the guide portion 72 may be made of a material having a first Young's modulus, and the second elastic sheet member 72*b* may be made of a material having a second Young's modulus larger than the first Young's modulus. For example, in the second embodiment, the upstream first elastic sheet member 172*a* of the upstream guide portion 172 may be made of a material having a first Young's modulus, and the upstream second elastic sheet member 172*b* may be made of a material having a second Young's modulus larger than the first Young's modulus. Further, the downstream first elastic sheet member 272*a* of the downstream guide portion 272 may be made of a material having a first Young's modulus, and the downstream second elastic sheet member 272*b* may be made of a material having a second Young's modulus larger than the first Young's modulus. As described above, when the first elastic sheet member and the second elastic sheet member are made of materials that differ from each other in Young's modulus, thicknesses of the first elastic sheet member and the second elastic sheet member may be set suitably.

Further, in any of the above-mentioned embodiments, the electrophotographic printer 100 is described as an example, but the present invention is not limited thereto. For example, the present invention is also applicable to an image forming apparatus of an ink jet system configured to form an image on a sheet through ejection of ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-250195, filed Dec. 26, 2017, which is hereby incorporated by reference herein in its entirety.

What is claimed is:

1. An image forming apparatus, comprising:

an image forming portion configured to form an image on a sheet;

a pair of conveyance rotary members, which is arranged downstream of the image forming portion in a sheet conveyance direction, and is configured to convey the sheet, on which the image is formed by the image forming portion, by a conveyance nip; and a guide portion configured to guide the sheet, on which the image is formed by the image forming portion, to the conveyance nip, the guide portion including:

a first guide sheet, which has a first stiffness, and includes an abutment surface configured to abut against the sheet; and a second guide sheet, which has a second stiffness higher than the first stiffness, and is arranged on a side opposite to the abutment surface of the first guide sheet, wherein the first guide sheet is made of resin and is deformed by the conveyed sheet, wherein the second guide sheet is arranged such that the second guide sheet receives a force applied by the sheet abutting against the abutment surface of the first guide sheet, and wherein a downstream edge of the first guide sheet in the sheet conveyance direction is arranged closer to the conveyance nip than a downstream edge of the second guide sheet in the sheet conveyance direction.

2. An image forming apparatus according to claim 1, wherein the first guide sheet is thinner than the second guide sheet.

3. An image forming apparatus according to claim 1, wherein the first guide sheet is made of a material having a first Young's modulus, and wherein the second guide sheet is made of a material having a second Young's modulus greater than the first Young's modulus.

4. An image forming apparatus according to claim 1, wherein the second guide sheet is bonded to a surface of the first guide sheet opposite to the abutment surface.

5. An image forming apparatus according to claim 1, further comprising a support member configured to support the guide portion, wherein the downstream edge of the first guide sheet projects farther downstream relative to the support member in the sheet conveyance direction than the downstream edge of the second guide sheet.

6. An image forming apparatus according to claim 5, wherein the support member is made of metal.

7. An image forming apparatus according to claim 1, wherein the downstream edge of the first guide sheet is located downstream of an upstream end position of the pair of conveyance rotary members in the sheet conveyance direction at the conveyance nip.

8. An image forming apparatus according to claim 1, wherein, in a width direction orthogonal to the sheet conveyance direction, the pair of conveyance rotary members extends wider than a maximum length in the width direction of the sheet that is usable.

9. An image forming apparatus according to claim 8, wherein, in the width direction, the guide portion is longer than the maximum length of the sheet that is usable.

10. An image forming apparatus according to claim 1, wherein the pair of conveyance rotary members comprises a first rotary member having a first outer diameter and a second rotary member having a second outer diameter greater than the first outer diameter, and is configured to correct a curl of the sheet by the conveyance nip formed by the first rotary member and the second rotary member.

11. An image forming apparatus according to claim 10, wherein the guide portion is arranged on the same side as the first rotary member with respect to a nip line at the conveyance nip.

12. An image forming apparatus according to claim 1, wherein the first guide sheet and the second guide sheet do not intersect a nip line at the conveyance nip.

13. An image forming apparatus according to claim 1, wherein the first guide sheet is arranged so as to approach a nip line at the conveyance nip from an upstream side toward a downstream side in the sheet conveyance direction.

14. An image forming apparatus according to claim 1, wherein the guide portion is arranged so as to allow the sheet conveyed in the sheet conveyance direction to be brought into contact with the abutment surface on an upstream side of the conveyance nip.

15. An image forming apparatus according to claim 1, wherein the guide portion is arranged so that a surface of the sheet on which the image is formed by the image forming portion is opposed to the abutment surface.

16. An image forming apparatus according to claim 1, wherein the second guide sheet is deformable by the sheet to be conveyed.

17. An image forming apparatus according to claim 1, wherein the first guide sheet is attached to the second guide sheet.

18. An image forming apparatus according to claim 1, further comprising:

a first conveyance path through which the sheet passes; and a second conveyance path through which the sheet passes, wherein the second conveyance path merges with the first conveyance path at a merging portion provided between the image forming portion and the pair of conveyance rotary members, wherein the guide portion guides the sheet passing through first conveyance path to the pair of conveyance rotary members, and wherein the guide portion guides the sheet passing through first conveyance path to the pair of conveyance rotary members.

19. An image forming apparatus according to claim 1, wherein the second guide sheet is made of resin.

20. An image forming apparatus according to claim 1, wherein the first guide sheet has a thickness of from 30 μm to 100 μm, and wherein the second guide sheet has a thickness of from 150 μm to 400 μm.

* * * * *